US006494726B1

(12) United States Patent
Auclair

(10) Patent No.: US 6,494,726 B1
(45) Date of Patent: Dec. 17, 2002

(54) CABLE RACK CLAMP

(75) Inventor: William T. Auclair, Winsted, CT (US)

(73) Assignee: Electric Motion Company, Inc., Winsted, CT (US)

( * ) Notice: Subject to any disclaimer, the term of this patent is extended or adjusted under 35 U.S.C. 154(b) by 17 days.

(21) Appl. No.: 09/994,183

(22) Filed: Nov. 26, 2001

(51) Int. Cl.[7] ..... H01R 4/66
(52) U.S. Cl. ..... 439/92; 439/797
(58) Field of Search ..... 439/92, 797, 811, 439/812, 793, 95, 100, 789, 796, 798, 801, 803, 805, 806, 807, 815

(56) References Cited

U.S. PATENT DOCUMENTS

| | | | | | |
|---|---|---|---|---|---|
| 2,191,258 | A | * | 2/1940 | Matthysse | 439/791 |
| 2,811,703 | A | * | 10/1957 | Becker | 439/803 |
| 4,784,621 | A | * | 11/1988 | Auclair | 439/793 |
| 5,320,565 | A | * | 6/1994 | Polidori | 439/791 |
| 6,045,414 | A | * | 4/2000 | DeFrance | 439/794 |
| 6,325,678 | B1 | * | 12/2001 | Auclair | 439/803 |

* cited by examiner

*Primary Examiner*—P. Austin Bradley
*Assistant Examiner*—Ross Gushi

(74) *Attorney, Agent, or Firm*—Alix, Yale & Ristas, LLP

(57) ABSTRACT

A cable rack clamp includes a clamping member, a base member, a retainer, and first and second bolts. The clamping member includes a longitudinally extending, U-shaped female mounting segment having a front wall and oppositely disposed side walls. A clamping segment extends laterally from the side walls at an end portion of the female mounting segment, forming an opening. The base member includes a longitudinally extending rack engagement portion having upper and lower segments. The lower segment extends laterally forward of the front surface of the upper segment to a longitudinally extending male mounting segment. The male mounting segment is dimensioned to be slidably received in the opening of the clamping member. The retainer may be inserted through the opening of the cable rack. The first bolt mounts the retainer to the base member and may be torqued to exert a clamping force between the retainer and the base member, whereby the retainer and the base member engage opposed sides of the rack to clamp the base member thereto. The second bolt mounts the clamping member to the base member and may be torqued to exert a clamping force between the clamping member and the base member. Ground conductors disposed between the either first bolt and the base member or between the clamping segment of the clamping member and the lower segment of the base member are clamped therebetween.

21 Claims, 8 Drawing Sheets

CABLE RACK CLAMP

BACKGROUND OF THE INVENTION

This invention relates generally to cable racks which are used to support heavy cables and splice cases in manholes and controlled environmental vaults. More particularly, the present invention relates to various devices and techniques for bonding the cable racks to a common ground point.

Cable racks to which the invention relates are commonly installed in manholes and controlled environmental vaults. The cable racks conventionally are elongated metal members which are vertically oriented and bolted to concrete walls by lag bolts or other conventional fastening means. T-slotted racks have a single elongated mounting surface having a row of T-shaped openings. The Unistrut P16F™ and P21H™ racks are elongated tubes having a substantially square cross-section. One set of opposed sides have a row of rectangular-shaped openings and the other set of opposed sides have a row of oval-shaped openings. Hooks for supporting heavy cables, splice cases and other products are removably installed upon insertion in the cable rack openings.

The cable rack environment is frequently subject to ground water contamination as well as significant quantities of corrosive compounds. Salt and other corrosive chemicals are also found in the ground water. Consequently, the ground water functions as an electrolytic solution relative to the racks. If the metal hardware of the cable racking in the controlled environmental vaults or manholes is not at the same electrical potential, the electrolytic system accelerates corrosion of the cable racks.

The tendency of the metal cable racks to corrode as a result of their presence in an electrolytic system, has dictated the common practice of connecting the cable racks to a common ground point. The conductor connection with a common ground point is commonly accomplished in a wide variety of on-site expediently devised techniques, the most common technique is simply to clamp the ground conductor between a pair of washers secured to a lag bolt which mounts the cable rack.

U.S. Pat. No. 5,094,622 discloses a bond clamp which attaches to a T-slotted cable rack for connecting a ground conductor. An L-shaped bolt is inserted in the T-slot to secure a pair of clamp members to the cable rack. The ground conductor is clamped 10 between the clamp members to provide the electrical bond connection with the cable rack. The base clamp members includes a pair of laterally extending guide flanges such that the base clamp member substantially encloses the front face and side portions of the T-slotted cable rack. Since commercially available T-slotted cable racks is narrower than the Unistrut racks, the guide flanges prevent use of these bond clamps on Unistrut racks.

SUMMARY OF THE INVENTION

Briefly stated, the invention in a preferred form is a cable rack clamp which comprises a clamping member composed of a corrosion-resistant, electrically conductive material. The clamping member includes a longitudinally extending, U-shaped female mounting segment having a front wall and oppositely disposed side walls. A clamping segment extends laterally from the side walls at an end portion of the female mounting segment. The clamping segment and front wall and side walls of the end portion define an opening. A base member composed of a corrosion-resistant electrically conductive material includes upper, lower and male mounting segments. The male mounting segment is dimensioned to be slidably received in the opening of the clamping member. A retainer composed of a corrosion-resistant, electrically conductive material may be inserted through the opening of the cable rack. A first bolt composed of a corrosion-resistant, electrically conductive material mounts the retainer to the base member and may be torqued to exert a clamping force between the retainer and the base member, whereby the retainer and the base member engage opposed sides of the rack to clamp the base member thereto. A second bolt composed of a corrosion-resistant, electrically conductive material mounts the clamping member to the base member and may be torqued to exert a clamping force between the clamping member and the base member. Ground conductors disposed between the either first bolt and the base member or between the clamping segment of the clamping member and the lower segment of the base member are clamped therebetween.

The first and second bolts each include a head, a threaded shaft and a flange of disposed intermediate the head and the threaded shaft. The flange of the first bolt is disposed adjacent the front surface of the base member, with the threaded shaft extending through the opening of the base member and engaging the threaded opening of the retainer. The diameter of the opening of the base member is greater than the outside diameter of the shaft, such that the shaft moves freely within the opening. The flange of the second bolt is disposed adjacent to the clamping member, with the threaded shaft extending through the opening of the clamping member to engage a longitudinally extending threaded bore of the male mounting segment.

The male mounting segment of the base member includes a pair of side surfaces, each having a longitudinally extending groove. Each of the side walls of the female mounting segment of the clamping member has a longitudinally extending ridge which is received in each of one of the grooves of the base member. The distance between the side walls is greater than the width of the male mounting segment, the height of the ridges is complimentary to the depth of the ridges, and the width of the grooves is greater than the thickness of the ridges.

The retainer has upper and lower portions, with the upper portion of the retainer extending laterally forward of the lower portion to form a shoulder. The shoulder of the retainer is supported on the lip of the opening of the cable rack.

It is an object of the invention to provide a new and improved ground clamp for electrically bonding a ground conductor to a cable rack.

It is also an object of the invention to provide a new and improved ground clamp specifically adapted for mounting to a cable rack to provide a ground connection of high integrity.

A further object of the invention is to provide a new and improved ground clamp for efficiently electrically bonding a wide variety of ground conductors to either a T-slotted cable rack or a Unistrut cable rack.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
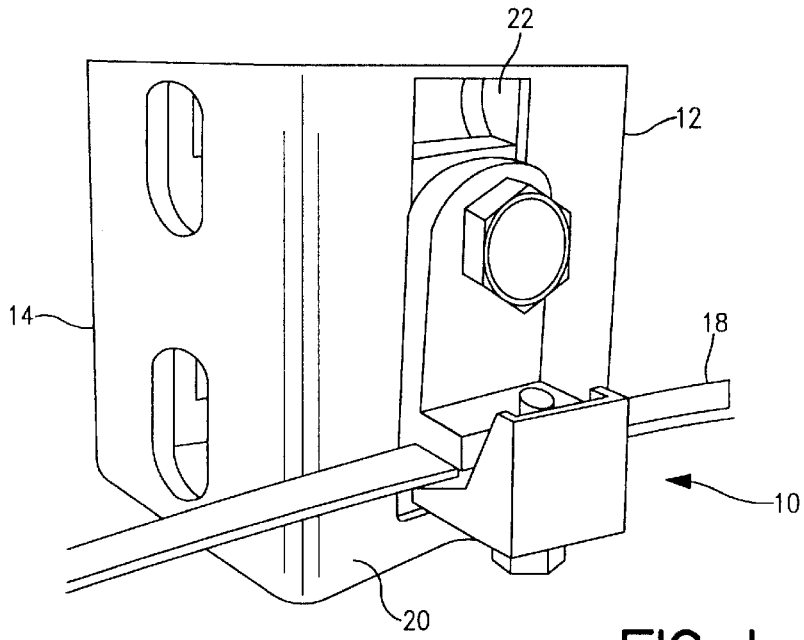
FIG. 1 is a perspective view of a Unistrut cable rack section, a first embodiment of a cable rack clamp in accordance with the invention, and a conductor electrically bonded to the cable rack by the ground clamp.

With reference to the drawings wherein like numerals represent like parts throughout the several figures, a cable rack clamp in accordance with the present invention is generally designated by the numeral 10. The cable rack clamp 10 is adapted for mounting on an electrically conductive cable rack 12, of either the Unistrut cable rack design 14 or the T-slotted cable rack design 16, for electrically connecting the cable rack 12 to a ground point which is common with other cable racks 12. The cable rack clamp 10 is suitable for connecting with a ground conductor 18, such as a ribbon conductor, a No. 6 AWG ground wire, a braided conductor, a band conductor, and other conductors. The cable rack clamp 10 is adapted to easily attach to the cable rack 12 for establishing electrical connection with the ground conductor 18.

The cable rack 12 is a conventional T-slotted cable rack 16 or a conventional Unistrut cable rack 14 which is installed in manholes, controlled environmental vaults and other similar environments for supporting various cables and other objects. Such cable racks 12 are conventionally elongated metal supports which are sectional. Two or more rack sections can be bolted together to form one vertical face panel 20, 20' which has a vertical series of aligned openings 22, 22' (T-slots in the case of the T-slotted cable rack and rectangular openings in the case of the Unistrut cable rack). The T-slotted cable rack 16 also typically includes a pair of opposed reinforced edges which function to offset the face panel 20' of the rack from the wall. The Unistrut cable rack 14 also typically includes a rear panel and a pair of side panels which function to offset the face panel 20 of the rack from the wall.

The cable rack 12 is mounted to the wall by means of lag bolts (not illustrated). The principal function of the cable rack clamp 10 is to electrically bond the cable rack 12 with a ground conductor 18 so that all of the cable racks 12 in a given environment may be connected to a common ground point. The grounded circuit inhibits corrosion of the racks 12 due to ground water contaminated systems which are electrolytic in function.

With reference to FIGS. 3–7, the cable rack cable rack clamp 10 comprises a one-piece base member 24 composed of a corrosion-resistant electrically conductive material, preferably silicon bronze. The base member 24 includes a longitudinally extending rack engagement portion having upper, lower and male mounting segments 26, 28, 30. In a first embodiment of the base member 24, the lower segment 28 extends laterally forward of the front surface 32 of the upper segment 26 to the longitudinally extending male mounting segment 30, such that the upper surface 34 of the lower segment 28 is co-planar with the upper surface 36 of the male mounting segment 30. The lower surface 38 of lower segment 28 and the rear surface 40 of male mounting segment 30 form four sides of a hexagonal receptacle 42 (as explained further below). A threaded bore 44 and grooves 46 in the side surfaces 48 extend longitudinally from the upper surface 36 to the lower surface 50 of the male mounting segment 30. A circular opening 52 extends from the front surface 32 to the back surface 54 of the upper segment 26.

With reference to FIGS. 3 and 8–10, a substantially rectangular retainer 56 is dimensioned for insertion through the opening 22, 22' of the cable rack 12, having a width 58 which is smaller than the width 60 of both the lower portion of a conventional T-slot and the opening 22 of a conventional Unistrut cable rack 14. The retainer 56 is composed of a corrosion-resistant, electrically conductive material, preferably brass. The upper portion 62 of the retainer 56 extends laterally forward of the lower portion 64, forming a shoulder 66. A threaded opening 68 extends laterally through the retainer 56 and is preferably located intermediate the upper end and the middle of the retainer 56.

Figure 14:
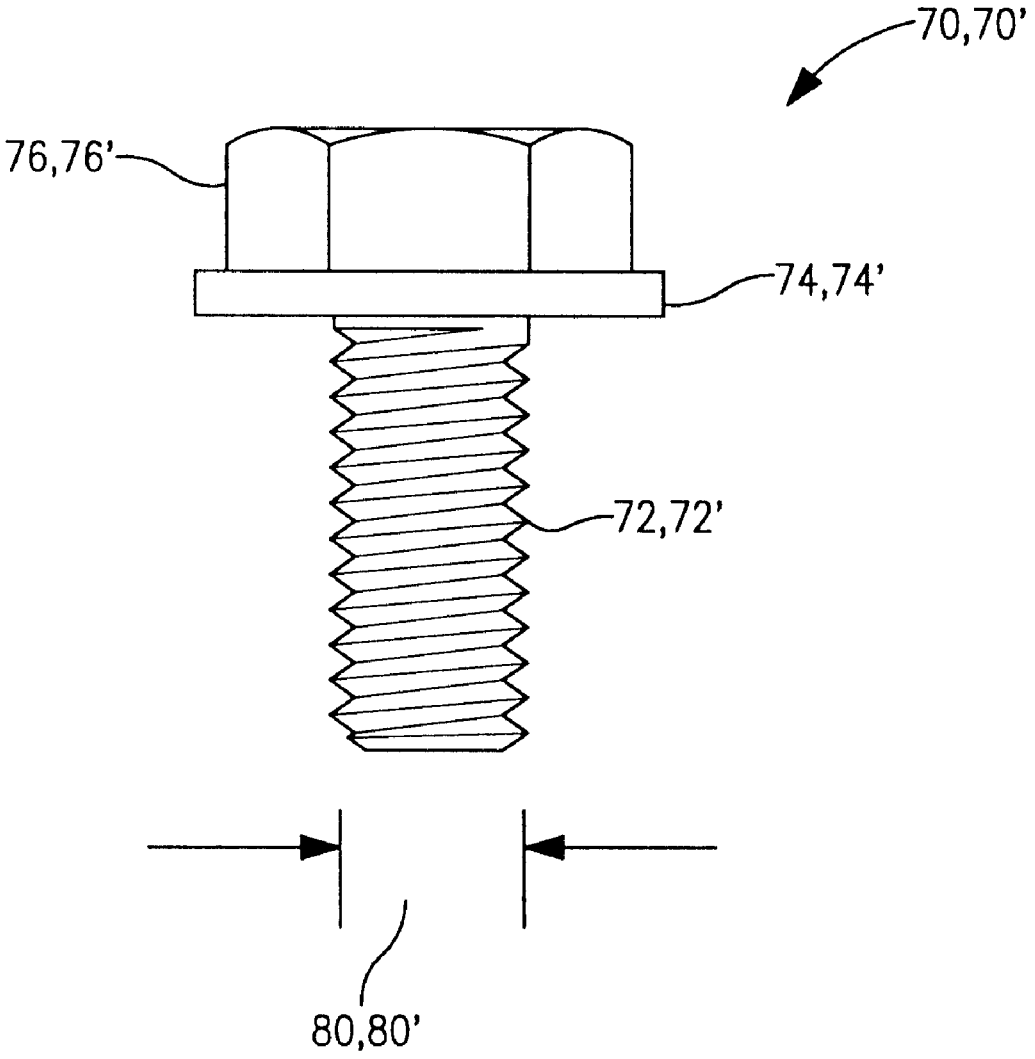
FIG. 14 is a side view of the bolt of the cable rack clamp of FIG. 3.

The retainer 56 is secured to the base member by a bolt 70 (FIG. 14) composed of a corrosion-resistant electrically conductive material, preferably silicon-bronze. The bolt 70 includes a threaded shaft 72, a flange 74 and a head 76. The head 76 and flange 74 are disposed adjacent to the front surface 32 of upper segment 26 and the threaded shaft 72 extends through opening 52 and is threadably engaged in opening 68. The inside diameter 78 of the opening 52 in the base member 24 is larger than the outside diameter 80 of the shaft 72 to allow free movement of the shaft 72 in opening 52, facilitating insertion of the retainer 56 through the opening 22, 22' in the cable rack 12 as described below. In a preferred embodiment, the inside diameter 78 of opening 52 is 0.350 inches and the diameter 80 of the threaded shaft 72 is 0.3125 inches.

With reference to FIGS. 3, 4 and 11–13, a clamping member 82 includes a longitudinally extending, U-shaped female mounting segment 84 having a front wall 86 and oppositely disposed side walls 88. The clamping member 82 is composed of a corrosion-resistant, electrically conductive material, preferably silicon bronze. A longitudinal ridge 90 extends laterally inward from the inner surface 92 of each side wall 88. The distance 94 between the inner surfaces 92 is slightly greater than the width 96 of male mounting segment 30 and the height 98 of the ridges 90 is complementary to the depth 100 of the grooves 46, such that the male mounting segment 30 of the base member 24 may be easily inserted into the channel 102 formed by the female mounting segment 84. A clamping segment 104 extends laterally from an end portion 106 of the female mounting segment 84, defining a rear wall 108 which forms a fully enclosed opening 110 in end portion 106. The V-shaped upper surface 112 of the clamping segment 104 forms the remaining two sides of the hexagonal receptacle 42. In a preferred embodiment, the width 96 of male mounting segment 30 is smaller than the width of lower segment 28 and the width of the clamping member is substantially equal to the width of the lower segment 28.

The clamping member 82 is secured to the base member by a bolt 70' composed of a corrosion-resistant electrically conductive material. Similar to bolt 70, bolt 70' is preferably composed of silicon-bronze and includes a threaded shaft 72', a flange 74' and a head 76'. The head 76' and flange 74' are disposed adjacent to the bottom 114 of the clamping member 82 and the threaded shaft 72' extends through opening 110 and is threadably engaged in bore 44. Preferably, the distance 116 between the front and rear walls 86, 108 is greater than the diameter 80' of the shaft 72' of bolt 70', the width 118 of the grooves 46 is greater than the thickness 120 of the ridges 90, and the distance 122 between the ridges 90 and the inside surface 124 of the front wall 86 is greater than the thickness 126 of the flanges 128 formed by grooves 46, providing a loose fit between male mounting segment 30 and female mounting segment 84.

To mount the cable rack clamp 10 to the cable rack 12, bolt 70 is rotated counter-clockwise until only the distal end portion of the shaft 72 is threadably retained in opening 68 and the retainer 56 to positioned at an angle to the base member 24. The lower portion 64 of the retainer 56 is inserted through the opening 22, 22' of the cable rack 12 such that lower portion 64 is positioned behind the rear surface of the face panel 20, 20'. The retainer 56 and bolt 70 are then pivoted such that the front surface 130 of the lower portion 64 of the retainer 56 and rear surface 54 of the base member 24 are substantially parallel to the face panel 20, 20' of the cable rack 12. The overall length of the retainer 56 and the longitudinal position of threaded opening 68 are selected such that the upper end 132 of the retainer 56 does not contact the face panel 20, 20' of the cable rack 12 as the retainer 56 and bolt 70 are pivoted. Bolt 70 is then rotated clock-wise, drawing the retainer and base member 24 into clamping engagement with face panel 20, 20' of the cable rack 12. Preferably, the upper portion 62 of the retainer 56 extends into the opening 22, 22' of the cable rack 12 such that shoulder 66 rests on the edge of the opening 22, 22', thereby preventing contact between threaded shaft 72 and the edge which could mar the thread.

Figure 2:
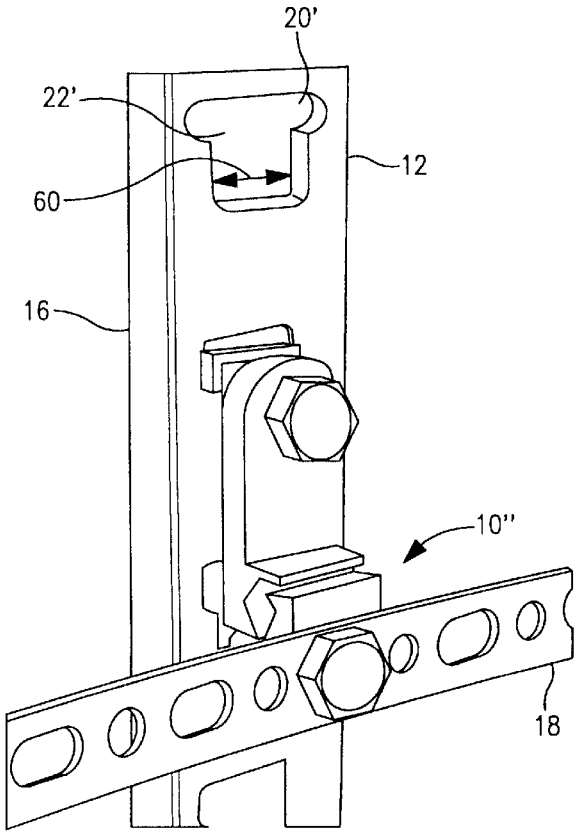
FIG. 2 is a perspective view of a T-slotted cable rack section, a cable rack clamp having the base member of FIG. 17, and a conductor electrically bonded to the cable rack by the ground clamp.
Figure 4:
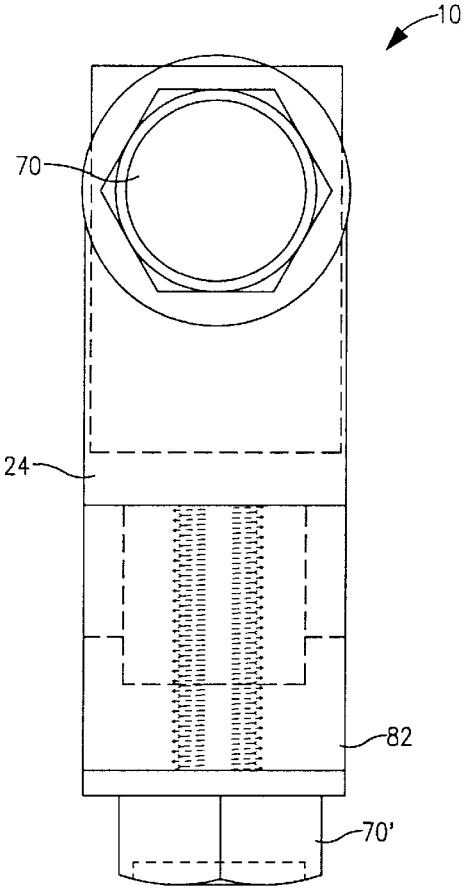
FIG. 4 is a bottom view, partially in phantom, of the cable rack clamp of FIG. 3.
Figure 3:
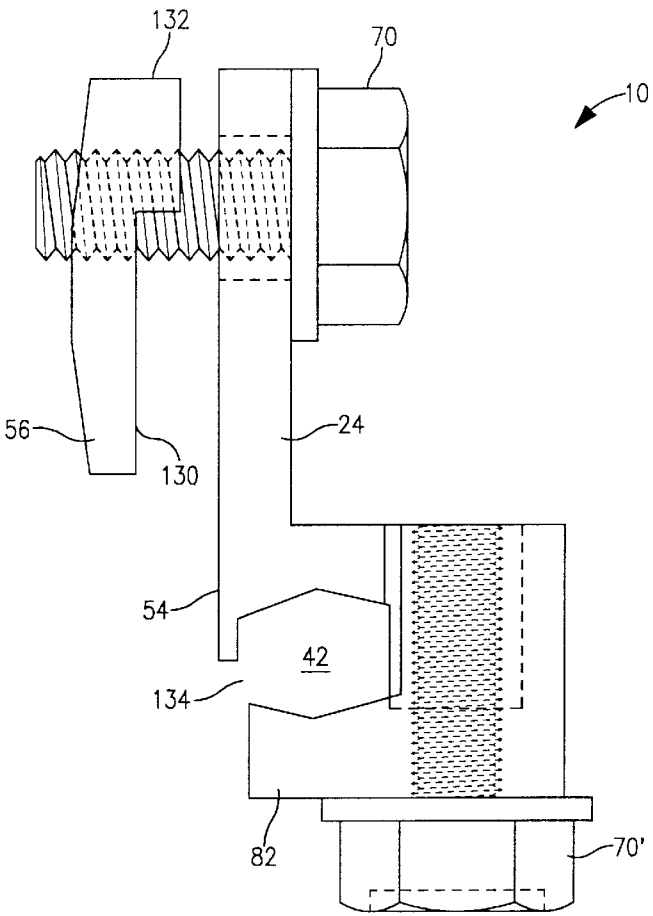
FIG. 3 is an enlarged side view, partially in phantom, of the cable rack clamp of FIG. 1.
Figure 7:
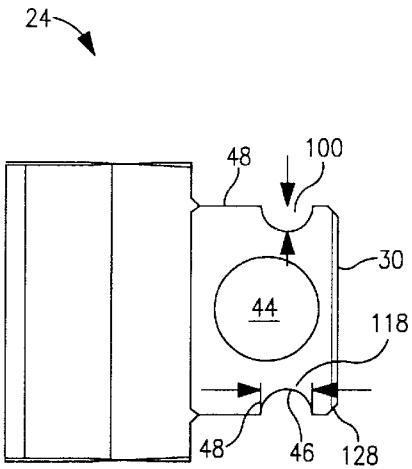
FIG. 7 is a front view of the base member of the cable rack clamp of FIG. 5.
Figure 6:
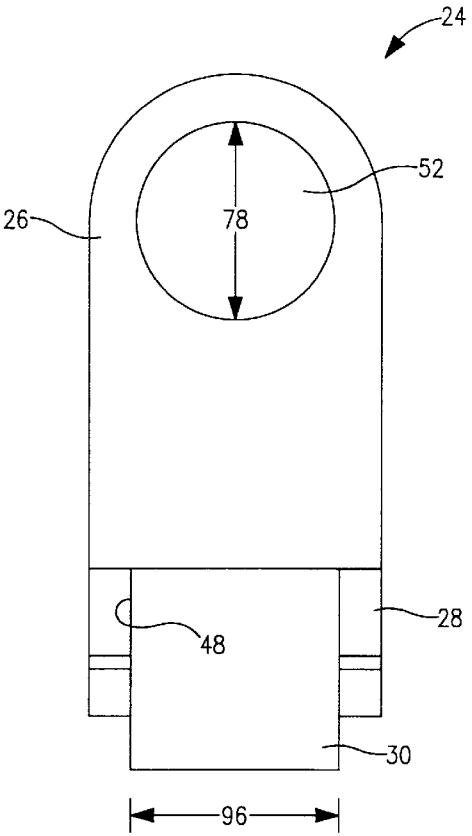
FIG. 6 is a bottom view of the base member of the cable rack clamp of FIG. 5.
Figure 5:
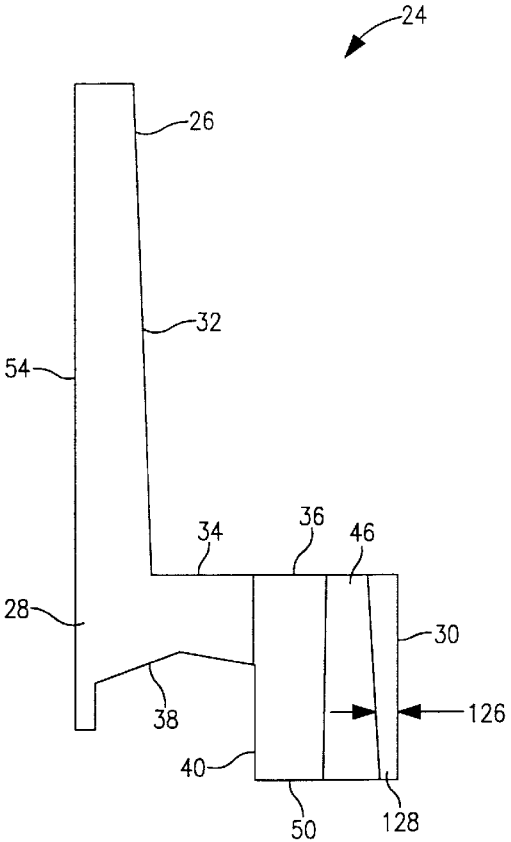
FIG. 5 is a side view of the base member of the cable rack clamp of FIG. 3.
Figure 8:
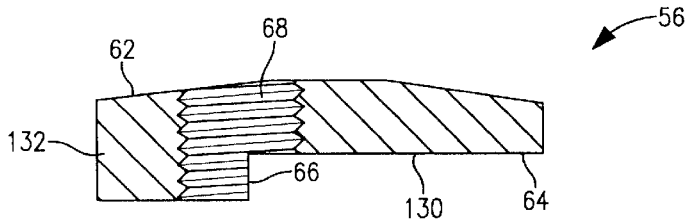
FIG. 8 is a cross-section view of the retainer of the cable rack clamp of FIG. 3.
Figure 9:
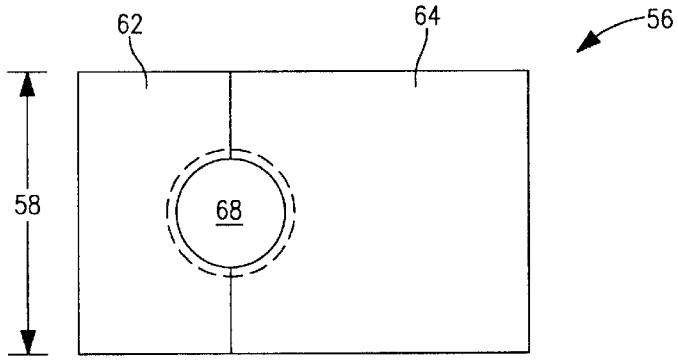
FIG. 9 is a bottom view of the retainer of the cable rack clamp of FIG. 8.
Figure 10:
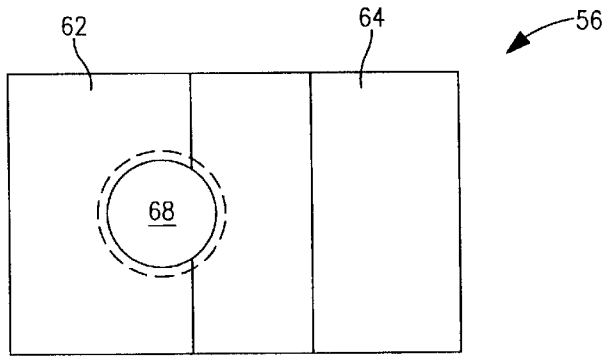
FIG. 10 is a top view of the retainer of the cable rack clamp of FIG. 8.
Figure 11:
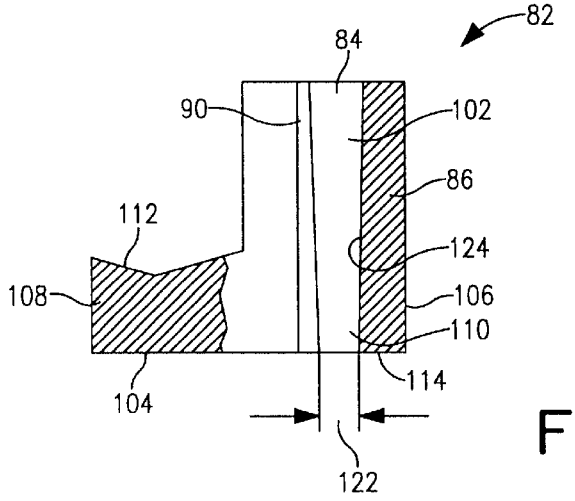
FIG. 11 is a cross-section view of the clamping member of the cable rack clamp of FIG. 3.
Figure 12:
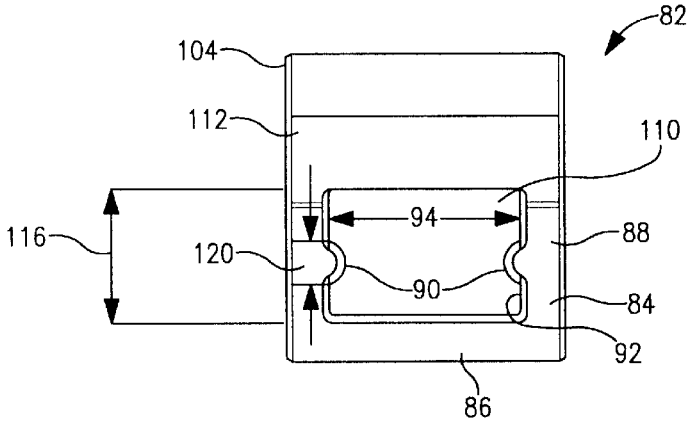
FIG. 12 is a top view of the clamping member of the cable rack clamp of FIG. 11.
Figure 13:
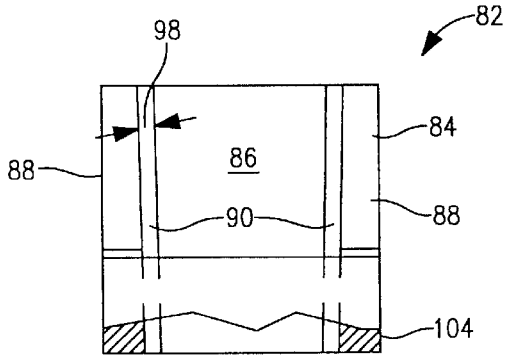
FIG. 13 is a rear view, partly in phantom, of the clamping member of the cable rack clamp of FIG. 3.

The ground conductor 18 may then be mounted to the cable rack clamp 10. Bolt 70' may be loosened, allowing the clamping member 82 to be pulled away from the base member 24 a sufficient distance to form a gap 134 between the clamping segment 104 of the clamping member 82 and the lower segment 28 of the base member 24. The ground conductor 18 may then be inserted into receptacle 42 through the passage formed by the gap 134. Tightening bolt 70' clamps the ground conductor 18 within receptacle 42, as shown in FIG. 1. If the ground conductor 18 is a perforated bonding ribbon, the threaded shaft 72' of bolt 70' may be disengaged from bore 44, and withdrawn from opening 110. Shaft 72' is then inserted through one of the perforations of the ribbon and opening 110 and threadably engaged in bore 44. Tightening bolt 10' clamps the ground conductor 18 between the flange 74' of bolt 70' and the clamping member 82, as shown in FIG. 2.

Figure 15:
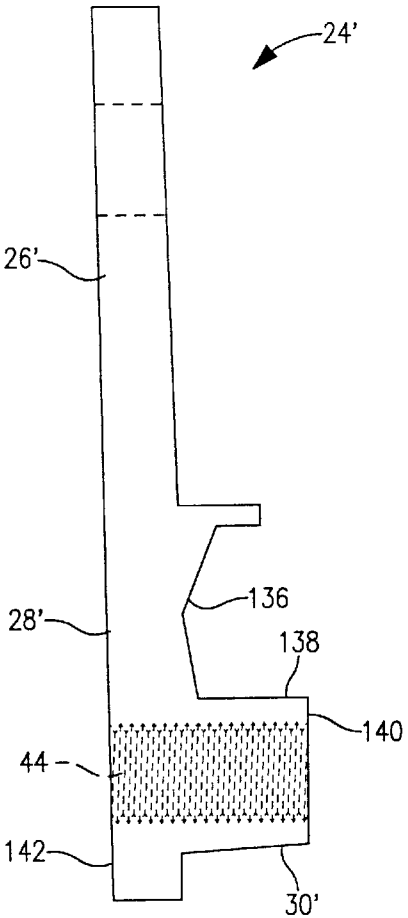
FIG. 15 is an enlarged side view, partly in phantom of a second embodiment of a base member in accordance with the invention.
Figure 16:
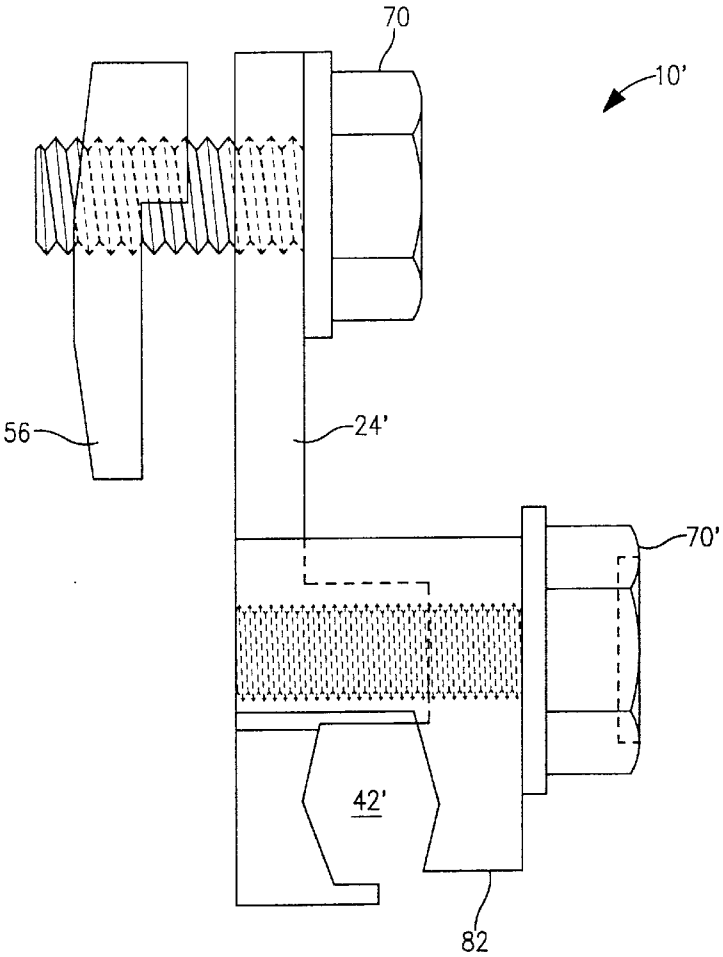
FIG. 16 is a side view, partially in phantom, of a cable rack clamp having the base member of FIG. 15.

With reference to FIG. 15, in a second embodiment of the base member 24', the lower segment 28' extends longitudinally from the upper segment 26' to the laterally extending male mounting segment 30'. The front surface 136 of lower segment 28' and the upper surface 138 of male mounting segment 30' form four sides of the hexagonal receptacle 42'. The threaded bore 44 and the grooves 46 in the side surfaces 48 extend laterally from the front surface 140 to the back surface 142 of the male mounting segment 30'. When the cable rack clamp 10' is assembled, as shown in FIG. 16, the V-shaped surface 112 of the clamping member 82 forms the remaining two sides of the hexagonal receptacle 42'.

Figure 17:
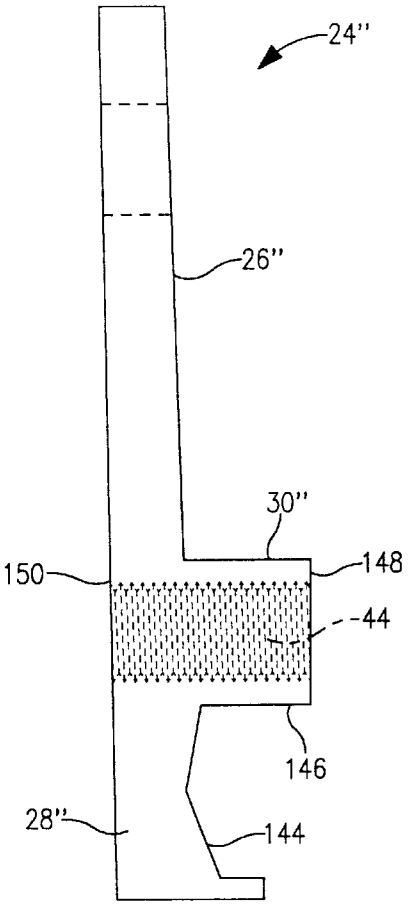
FIG. 17 is an enlarged side view, partly in phantom of a third embodiment of a base member in accordance with the invention.
Figure 18:
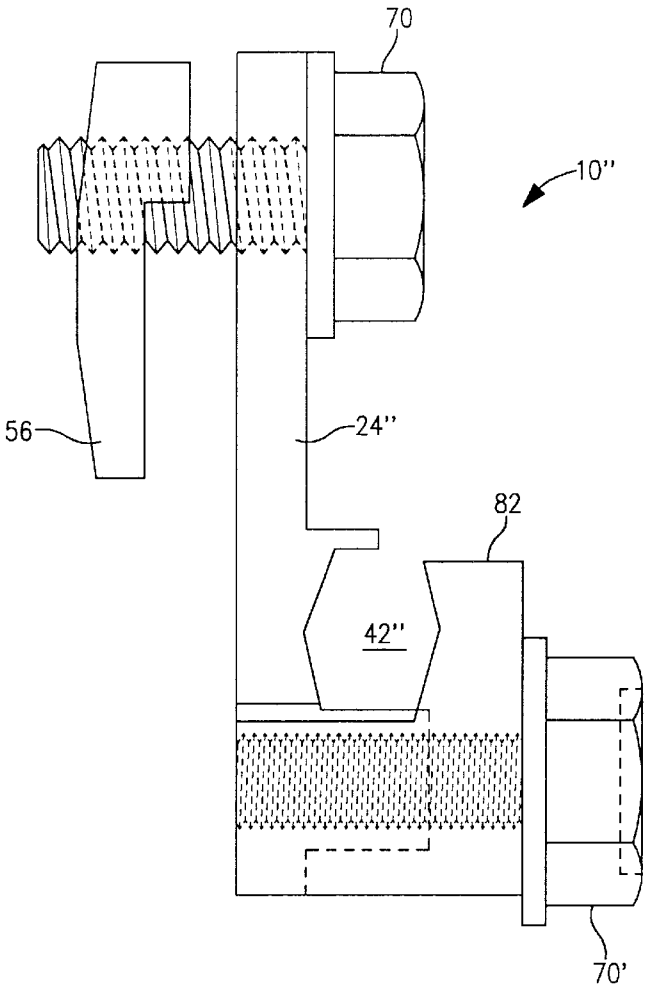
FIG. 18 is a side view, partially in phantom, of a cable rack clamp having the base member of FIG. 17.

With reference to FIG. 17, in a third embodiment of the base member 24", the laterally extending male mounting segment 30" is disposed intermediate the upper and lower segments 26", 28". The front surface 144 of lower segment 28" and the lower surface 146 of male mounting segment 30" form four sides of the hexagonal receptacle 42". The threaded bore 44 and the grooves 46 in the side surfaces 48 extend laterally from the front surface 148 to the back surface 150 of the male mounting segment 30". When the cable rack clamp 10" is assembled, as shown in FIG. 18, the V-shaped surface 112 of the clamping member 82 forms the remaining two sides of the hexagonal receptacle 42".

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A ground clamp for bonding a ground conductor to a cable rack of a type having a row of openings for removably mounting hooks comprising:

a clamping member composed of a corrosion-resistant, electrically conductive material, the clamping member including a longitudinally extending, U-shaped female mounting segment having a front wall and oppositely disposed side walls, a clamping segment extending laterally from the side walls at an end portion of the female mounting segment, the clamping segment and front wall and side walls of the end portion defining an opening;

a base member composed of a corrosion-resistant electrically conductive material, the base member including upper, lower and male mounting segments and front and back surfaces, the male mounting segment being dimensioned to be slidably received in the opening of the clamping member;

a retainer composed of a corrosion-resistant, electrically conductive material, the retainer being adapted for insertion through the opening of the cable rack; and first and second bolts composed of a corrosion-resistant, electrically conductive material, the first bolt mounting the retainer to the base member and being torqueable to exert a clamping force between the retainer and the base member, whereby the retainer and the base member engage opposed sides of the rack to clamp the base member thereto, the second bolt mounting the clamping member to the base member and being torqueable to exert a clamping force between the clamping member and the base member, and whereby a ground conductor disposed between the first bolt and the base member or a ground conductor disposed between the clamping segment of the clamping member and the lower segment of the base member is clamped therebetween.

2. The ground clamp of claim 1 wherein the upper segment of the base member defines a substantially circular opening having an inside diameter and the first bolt includes a threaded shaft having an outside diameter the inside diameter of the opening being greater than the outside diameter of the shaft, whereby the shaft moves freely within the opening.

3. The ground clamp of claim 1 wherein the lower segment extends laterally forward of the front surface of the upper segment to the longitudinally extending male mounting segment.

4. The ground clamp of claim 3 wherein the lower segment of the base member has a v-shaped lower surface, the male mounting segment of the base member has a rear surface, and the clamping segment of the clamping member has a v-shaped upper surface, the lower surface, the rear surface and the upper surface forming a substantially hexagonal-shaped receptacle adapted for receiving a ground conductor.

5. The ground clamp of claim 1 wherein the second bolt includes a head and a threaded shaft and the male mounting segment defines a longitudinally extending threaded bore, the threaded shaft of the second bolt extending through the opening of the clamping member to threadably engage the threaded bore of the male mounting segment, the head of the second bolt being disposed adjacent to the clamping member.

6. The ground clamp of claim 1 wherein the male mounting segment of the base member has a pair of side surfaces defining a width and the side walls of the female mounting segment of the clamping member define a distance, the distance between the side walls being greater than the width of the male mounting segment.

7. The ground clamp of claim 6 wherein each of the side walls of the female mounting segment of the clamping member has a longitudinally extending ridge and the side surface of the male mounting segment each have a longitudinally extending groove, a ridge of the clamping member being received in each of the grooves of the base member.

8. The ground clamp of claim 7 wherein each of the ridges has a height and each of the grooves has a depth, the height of the ridges being complimentary to the depth of the ridges.

9. The ground clamp of claim 8 wherein each of the ridges has a thickness and each of the grooves has a width, the width of the grooves being greater than the thickness of the ridges.

10. The ground clamp of claim 9 wherein the retainer defines a threaded opening extending laterally through the upper and lower portions of the retainer.

11. The ground clamp of claim 1 wherein the retainer has upper and lower portions, the upper portion of the retainer extends laterally forward of the lower portion and forming a shoulder.

12. The ground clamp of claim 1 wherein the lower segment extends longitudinally from the upper segment to the laterally extending male mounting segment.

13. The ground clamp of claim 12 wherein the lower segment of the base member has a v-shaped front surface, the male mounting segment of the base member has an upper surface, and the clamping segment of the clamping member has a v-shaped rear surface, the front surface, the upper surface and the rear surface forming a substantially hexagonal-shaped receptacle adapted for receiving a ground conductor.

14. The ground clamp of claim 1 wherein the laterally extending male mounting segment is disposed intermediate the upper and lower segments.

15. The ground clamp of claim 14 wherein the lower segment of the base member has a v-shaped front surface, the male mounting segment of the base member has a lower surface, and the clamping segment of the clamping member has a v-shaped rear surface, the front surface, the lower surface and the rear surface forming a substantially hexagonal-shaped receptacle adapted for receiving a ground conductor.

16. A ground assembly comprising:

a cable rack having an elongated support member having oppositely disposed front and rear faces and defining a row of openings;

a base member including upper, lower and male mounting segments and front and back surfaces;

a retainer dimensioned for insertion through an opening of the cable rack;

a first bolt mounting the retainer to the base member and being torqueable to exert a clamping force between the retainer and the base member, whereby the base member and the retainer engage the front and rear faces of the support member to clamp the base member to the cable rack and to clamp a ground conductor disposed between the first bolt and the base member;

a clamping member including a longitudinally extending, U-shaped female mounting segment having a front wall and oppositely disposed side walls, a clamping segment extending laterally from the side walls at an end portion of the female mounting segment, the clamping segment and front wall and side walls of the end portion defining an opening dimensioned for receiving the male mounting segment of the base member; and a second bolt mounting the clamping member to the base member and being torqueable to exert a clamping force between the clamping member and the base member, whereby a ground conductor disposed between the clamping segment of the clamping member and the lower segment of the base member is clamped therebetween.

17. The ground assembly of claim 16 wherein the retainer defines a laterally extending threaded opening, the first bolt includes a head, a threaded shaft and a flange of disposed intermediate the head and the threaded shaft, and the upper segment of the base member defining a substantially circular opening, the flange of the first bolt being disposed adjacent the front surface of the base member, the threaded shaft extending through the opening of the base member and threadably engaging the threaded opening of the retainer, the threaded shaft having a diameter and the opening of the base member having an inside diameter which is greater than the outside diameter of the shaft, whereby the shaft moves freely within the opening.

18. The ground assembly of claim 16 wherein the second bolt includes a head, a threaded shaft and a flange disposed intermediate the head and the threaded shaft, and the male mounting segment of the base member defines a threaded bore, the flange of the second bolt being disposed adjacent to the clamping member, the threaded shaft extending through the opening of the clamping member to threadably engage the threaded bore of the male mounting segment.

19. The ground assembly of claim 16 wherein the male mounting segment of the base member includes a pair of side surfaces, each of the side surfaces having a longitudinally extending groove, and each of the side wails of the female mounting segment of the clamping member has a longitudinally extending ridge, a ridge of the clamping member being received in each of the grooves of the base member.

20. The ground assembly of claim 19 wherein the side surfaces of the male mounting member define a width, the side walls of the female mounting segment of the clamping member define a distance, each of the ridges has a height and a thickness, and each of the grooves has a depth and a width, the distance between the side walls being greater than the width of the male mounting segment, the height of the ridges being complimentary to the depth of the ridges, the width of the grooves being greater than the thickness of the ridges.

21. The ground assembly of claim 16 wherein each opening of the cable rack has a lip and the retainer has upper and lower portions, the upper portion of the retainer extending laterally forward of the lower portion and forming a shoulder, the shoulder of the retainer being supported on the lip of the opening.

* * * * *

UNITED STATES PATENT AND TRADEMARK OFFICE

CERTIFICATE OF CORRECTION

PATENT NO. : 6,494,726 B1
DATED : December 17, 2002
INVENTOR(S) : Auclair

It is certified that error appears in the above-identified patent and that said Letters Patent is hereby corrected as shown below:

Column 9,
Line 8, delete “wails” and insert -- walls --.

Signed and Sealed this

Twentieth Day of January, 2004

JON W. DUDAS
*Acting Director of the United States Patent and Trademark Office*